US005680901A

United States Patent [19]

Gardes

[11] Patent Number: 5,680,901

[45] Date of Patent: Oct. 28, 1997

[54] RADIAL TIE BACK ASSEMBLY FOR DIRECTIONAL DRILLING

[76] Inventor: Robert Gardes, P.O. Box 92593, Lafayette, La. 70509

[21] Appl. No.: 572,042

[22] Filed: Dec. 14, 1995

[51] Int. Cl.[6] ..... E21B 43/14

[52] U.S. Cl. ..... 166/313; 166/50

[58] Field of Search ..... 166/313, 50, 52, 166/717.5

[56] References Cited

U.S. PATENT DOCUMENTS

| | | | |
|---|---|---|---|
| 4,489,782 | 12/1984 | Perkins | 166/50 X |
| 5,115,872 | 5/1992 | Brunet et al. | 166/50 |
| 5,388,648 | 2/1995 | Jordan, Jr. | 166/50 X |
| 5,564,503 | 10/1996 | Longbottom et al. | 166/313 |

*Primary Examiner*—William P. Neuder
*Attorney, Agent, or Firm*—Pravel, Hewitt, Kimball & Krieger

[57] ABSTRACT

A method for receiving hydrocarbon flow from multiple radial wells drilled in a single borehole which includes the steps of providing a principal vertical or horizontal cased well; positioning an inner casing within a portion of a cased well, the inner casing sealed at its upper and lower end portions against the wall of the outer casing and having a flowbore through it, the inner casing defining a radial tie back assembly; lowering a drill string into the assembly and drilling a radial well through the wall of the outer casing; retrieving the drill string and lowering a production liner into the inner casing; sealing around the wall of the liner so that all production from the formation flows through the liner to a point inside the inner casing; positioning a second length of inner casing at a point above the first length of casing, and repeating the steps of producing flow from a radial well out of that particular length of casing positioning a second radial tie back assembly at a point above the first radial tie back assembly, and drilling a radial well therefrom for receiving production from the radial tie back assembly; and allowing hydrocarbons within the formation to flow from the lowermost radial tie back assembly through a continuous bore in any radial tie back assembly placed above the lowermost assembly, so that all the hydrocarbons from the radial wells bored out of the single borehole would flow unimpeded to the surface.

13 Claims, 6 Drawing Sheets

RADIAL TIE BACK ASSEMBLY FOR DIRECTIONAL DRILLING

BACKGROUND OF THE INVENTION

1. Field of the Invention

The apparatus of the present invention relates to directional drilling for oil and gas. More particularly, the present invention relates to a novel assembly for the recovery of oil or gas from multiple radials which have been drilled from either a horizontal or vertical well, so that each of the radials can be produced simultaneously.

2. General Background

In the drilling of oil wells, modern technology has allowed oil wells to be drilled either in the vertical manner, or to be drilled so that the borehole results in a horizontal direction. Because hydrocarbons often lie within strata at various depths under the earth's surface, when a vertical or horizontal well is drilled, the technology now allows that multiple radial wells can be drilled from either the horizontal or the vertical well, in order to penetrate the strata containing the hydrocarbons. Quite often, the technology allows multiple radial wells to be drilled from either a vertical or horizontal well so that multiple pockets of hydrocarbons can be reached, and hopefully recovered to the surface.

One of the principal problems which is now occurring in this technology, is the manner in which the multiple radial wells can be completed so that the hydrocarbons can be fully recovered through each of the completed wells. For example, one problem lies in the fact that if the radial is in an unconsolidated formation, there must be a technique so that the wellbore can be sealed back to the main wellbore so the formation surrounding the intersection of the main wellbore and the radial will (1) not collapse and (2) formation will not be produced with the hydrocarbons during the recovery of the hydrocarbon, so that sand or other strata is not drawn into the flow of the hydrocarbons or, in a worse case, where the sand formation around the vertical well may collapse, therefore resulting in the loss of the wellbore. Usually, in order to overcome this problem, once you have drilled a horizontal well in terms of completion, one would set a packer into the cased portion of the well, and a production liner would then be run into the new offset wellbore, which produces a complete seal between cased and uncased new wellbores. There is then results a seal between the wellbore and the surrounding strata, and production can be undertaken. However, in the current technology, if one were to mill a window in the casing and drill the well out, and the production liner is then run into the borehole, there is no current system for completing and tieing in the multiple radial boreholes into the vertical or horizontal principal well, in order to achieve recovery from each of the radial wells.

In the current technology, the process of under reaming would take place in order to attempt to seal off the radial wellbore. What occurs is that a section of casing would be cut out of the wall of the vertical or horizontal casing. After the casing is milled, the area would then be under reamed or enlarged from for example lets say a 7" cased hole to an under reamed area of 22". The 22" area would then be cemented in place. After the cement is in place, the cement would then be drilled out, using for example, a 6½" bit, and then the drilling takes place out of the cement area so that when the external packer would be set in order to achieve a seal, the packer would be set in cemented area, which is an impermeable environment which could be sealed off. The shortcoming in this technique is the fact that it is very difficult to undertake such a sealing process and feel assured that the seal has been set within the cement for each of the radial bores and cement integrity is unsure as well as a large pressure differential would not hold a good seal.

A system which is currently being utilized by a company, Sperry Sun, is referred to as a lateral tie back system. Basically, the system requires a retrievable whipstock that is run into the hole and which must be pulled out of the hole, and when the liner is run into the hole, there is a "window joint" that closes down over it and they are able to retrieve their whipstock leaving their liner in place. The problem with this system is that there is mechanical problems associated with the closing window. Therefore, there is a need in the art for a system which is an economical and proven method of tieing back radial recovery wells so that the hydrocarbons from the various radials may be retrieved above the ground.

SUMMARY OF THE PRESENT INVENTION

The system of the present invention solves the problem in the art in a simple and straight forward manner. What is provided is a radial tie back assembly system, which provides for producing horizontal or vertical wells, having a multiplicity of radial wells, so that production may be undertaken simultaneously. The method and system of the present invention includes lowering the radial tie back assembly into a cased borehole to a predetermined depth, the radial tie back assembly further including a portion of inner casing, the inner casing having upper and lower sealing members for sealing against the wall of the cased borehole when the assembly is lowered to the predetermined depth;

A whipstock portion formed in a portion of the bore of the assembly for accepting a drill string thereinto;

A flowbore potion extending between the upper and lower ends of the assembly for allowing hydrocarbons to flow therethrough from a point below the assembly during production;

A packer for setting the assembly within the borehole at its lowermost point;

A muleshoe J lock sub secured to the upper end of the assembly, for lowering the assembly down the borehole, with a gyro orienting tool attached to the upper end of the muleshoe J lock sub, for properly orienting the direction of the whipstock so that the radial borehole is drilled in the predetermined orientation, sealing the assembly against the inner wall of the casing with the top and lower seal and engaging the packer against the wall of the cased borehole;

Next, the J lock sub would be detached from the assembly, with the assembly sealed within the casing at the predetermined depth. A collet latch assembly would then be lowered into the borehole, and would engage the radial tie back assembly within the portion of the assembly above the whipstock.

Preferably, there would be a 5½ inch drill string with a collet assembly attached to the lower end. This would then engage the tieback assembly above the whipstock. Then, a mud motor assembly would be run inside the 5½ inch drill string, with a drill bit on its lower end, so that upon engaging the angulated wall of the whipstock, would move through the opening in the whipstock wall, and would bore through the wall of the cased borehole. Following the process of cutting the window through the wall of the case, the assembly would be retrieved and a directional drilling assembly would be run through the window in order to drill the radial borehole. Further, following the drilling of the radial borehole, the drill string would then be retrieved from the borehole, and the collet latch assembly would remain in place. Following the next step would require that a completion liner would then be lowered into the borehole and set in place within the radial bore hole, the liner extending into the formation and have an upper end point within the radial tie back assembly surrounded by a packer at its upper end. The packer would then be set and running string above packer would then be released and retrieved from wellbore. Following this step, the collet latch assembly is then s retrieved from the radial tie back assembly, and the radial well can then be produced. The well would be produced through the production string into the upper end of the assembly and out of the upper end into the cased borehole for collection at the surface. In the event that other radial boreholes would be drilled along the vertical or horizontal cased well, this method would subsequently be done at points above the lowermost radial tie back assembly, and the steps would be repeated. However, as the production would flow upward and would engage the assembly positioned above, the production would flow through the boreholes formed in the assembly body, and would continue to flow up onto the surface through a plurality of flow bores in the body. Therefore, with this system, a plurality of radial tie back assemblies could be positioned at various points along the cased well, and the flow upward from the lowermost assembly would not be restricted by the assembly above it due to the fact that the production may flow through the flowbore of the assembly next above it.

Therefore, it is a principal object of the present invention to provide a design of a completion system for recovering hydrocarbons from a cased vertical or horizontal borehole through a series of radial wells drilled though the casing, and for producing the series of radial wells simultaneously;

It is a further object of the present invention to provide a radial tie back assembly, which may be lowered into a cased borehole, sealed in place, and at least one radial well produced therethrough to the surface of the well;

It is a further principal object of the present invention to provide a radial tie back assembly having the ability to produce a radial well from the assembly and simultaneously allow hydrocarbon flow through the assembly for producing hydrocarbons from a radial well below the assembly without restricting the flow of hydrocarbons;

It is a further object of the present invention to provide a system of producing a plurality of radial wells in a cased borehole, whereby a series of tie back assemblies may be used along the length of the borehole, and yet production flow may flow from the lowermost assembly upward through the assemblies above it, and all radial wells may be produced at the surface with the assemblies in place during production.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
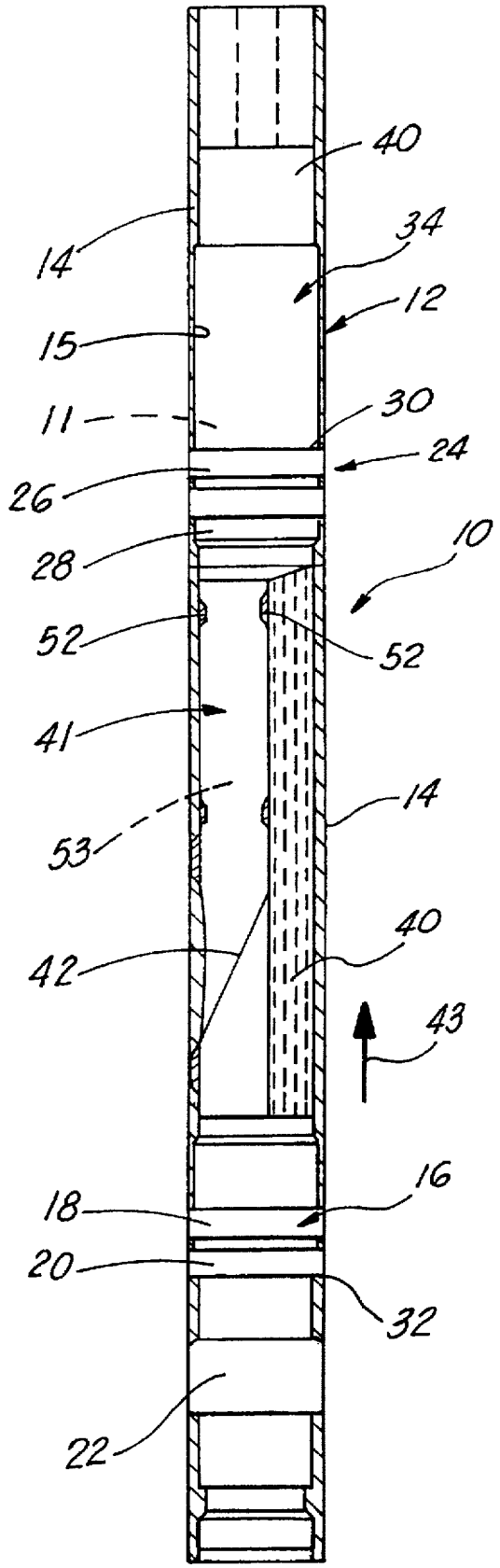
FIG. 1 is an overall view of the radial tie back assembly positioned within a cased borehole.

FIGS. 1–7B illustrate the preferred embodiment of the system utilized to carry out the process of the present invention. In the process of the present invention, the radial tie back assembly is illustrated in the figures, is utilized in order to produce a plurality of radially drilled wells from a single vertical or horizontal borehole, in such a manner that the wells may be produced simultaneously from different points along the length of the borehole. In the method of the present invention, there is provided a cased horizontal or vertical borehole drilled within the earth to a predetermined depth. Utilizing the system of the present invention as will be described in FIGS. 1–7B further, the radial tie back assembly is lowered into the borehole and is sealed in place with an upper and lower seal assembly, and a packer on its lowermost end. The radial tie back assembly is lowered into the hole through a combination of a muleshoe J lock sub and a gyro orienting tool at its upper end, so that when the assembly is placed at its predetermined depth, the gyro orienting tool orients a whipstock contained within the assembly to a specific orientation, and the muleshoe J lock sub is then disengaged from the assembly after the top and bottom seals of the assembly are sealed into place against the wall of the casing, and the packer on its lower end is expanded to grip the casing at the lowermost end. Following this step, a collet latch assembly is engaged into the radial tie back assembly and a radial drill string is then lowered into the assembly and contacting the whipstock bores through the wall of the casing and drills out the formation of a first radial well. Following this step, the drill string is then retrieved from the hole, and a production liner is lowered into the hole and the packer 15 engaged below the collet latch assembly, with the production liner serving to case off the production zone inside the radial bore. The running string is then released from the packer and retrieved to surface. The collet latch assembly is then disengaged within the radial tie back assembly and retrieved to surface. The well is now ready to be produced from its lowermost point through this assembly. Should subsequent radial wells want to be produced above this point, then each well would require an additional radial tie back assembly undergoing the same series of steps as was described above. In order to accommodate production flow from the lowermost assembly upward, in the event there are other radial tie back assemblies in place, each radial tie back assembly is provided with a flow bore throughout its length, so that as production flow reaches the next upper radial tie back assembly, the production flow flows through the flow bore from its lowermost end up out of its uppermost end and into the cased borehole until the flow engages another higher positioned radial tie back assembly and the flow would continue therethrough until the series of radial tie back assemblies are producing from different points along the length of the wellbore to the surface.

Figure 6:
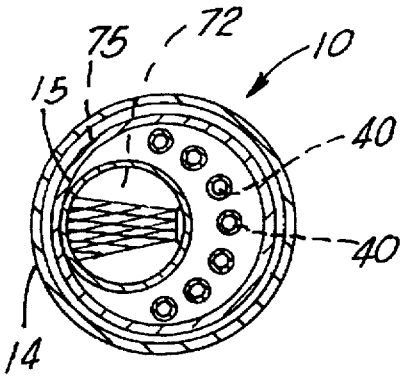
FIG. 6 is a top cross sectional view of the radial tie back assembly along lines 6—6 in FIG. 3.
Figure 7A:
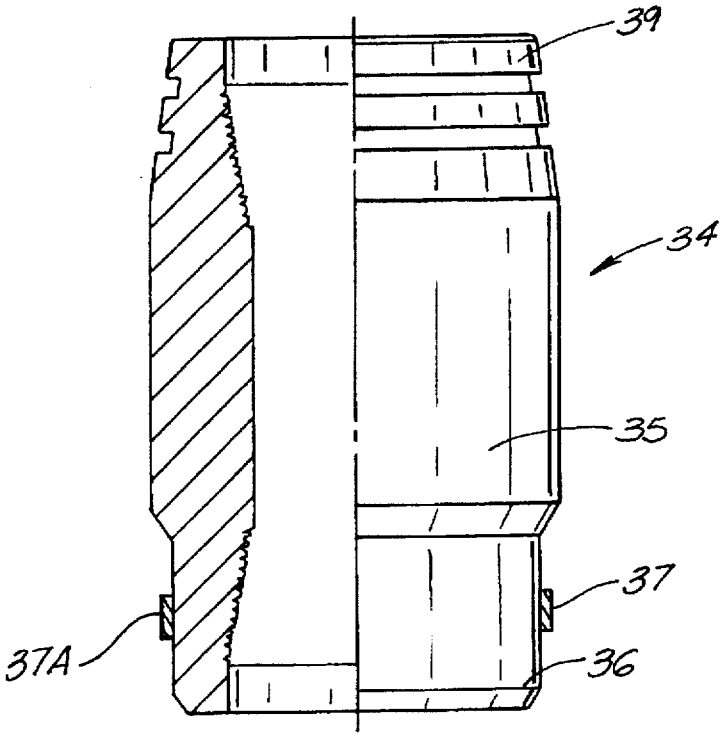
FIG. 7A and 7B are side cross sectional views of the muleshoe sleeve J lock sub utilized in the present invention.
Figure 7B:
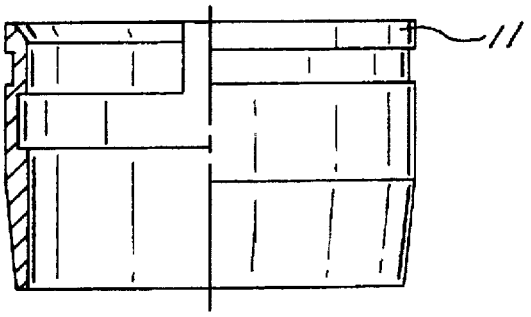

In order to accomplish the method of the present invention, reference is made to FIGS. 1–7B in the drawings. As seen in FIG. 1, the radial tie back assembly 10 is positioned within a primary borehole 12, with the casing 14 extending therethrough. The assembly 10 would include a bottom seal assembly 16, having a pair of upper annular seals 18 and 20, and a lower packer 22 set beneath the bottom seal assembly 16 for holding the assembly 10 at its lowermost point so that nothing will be able to flow past the seals 18, 20, between tie back assembly and the cased bore hole. There would also be provided a top seal assembly 24, having a pair of lower annular seals 26 and 28, which would when expanded seal against the inner surface 15 of the casing 14, so that there would be a seal on both the upper and lower ends 30, 32 respectively of the radial tie back assembly 10. During the process of setting the radial tie back assembly 10, it would be lowered into the borehole 12, with the use of a muleshoe J lock sub 34, which is illustrated in its entirety in FIGS. 7A and 7B. FIGS. 7A and 7B illustrate a muleshoe J lock sub 34. As illustrated in 7A, muleshoe J lock sub includes a body portion 35, having a lower end 36 with a pair of latching members 37, 37A. The upper end 39 of lock sub 34 would be attached to the gyro-orienting tool 40. The latching members 37, 37A, of the muleshoe J lock sub 34 would lock into the upper end 11 of the radial tie back assembly 10 and lowered into position as seen in FIG. 1. Once the assembly 10 is in the proper orientation and seals and packer set, the J lock sub 34 would be disengaged and brought up to the surface with the assembly 10 set in place downhole. The assembly 10 is set in the proper orientation within the borehole through the use of the gyro orienting tool 36, as illustrated in FIG. 1.

The purpose of orienting the assembly 10 within the hole and the proper orientation is the fact that the main assembly would include a whipstock 41 as one portion of the assembly 10. Such a whipstock 41 is known in the art and includes an angulated floor portion 42, so that when a drill bit makes contact with the floor portion 42, the drill bit is angulated into the wall of the cased hole and bores through the wall and out to begin a radial borehole. Therefore, the whipstock surface 42 must be oriented in the precise orientation so that when the drill bit makes its exit through the wall of the casing 14, it is oriented in the direction as was predetermined at the floor of the well. Further, the radial tie back assembly 10 would include a series of flow bores 40 extending from its upper end 30 through its lower end 32, for allowing hydrocarbons to flow upward through the assembly during the production, in the direction of arrow 43 as seen in FIG. 1. This flow bore will be discussed further.

Figure 2:
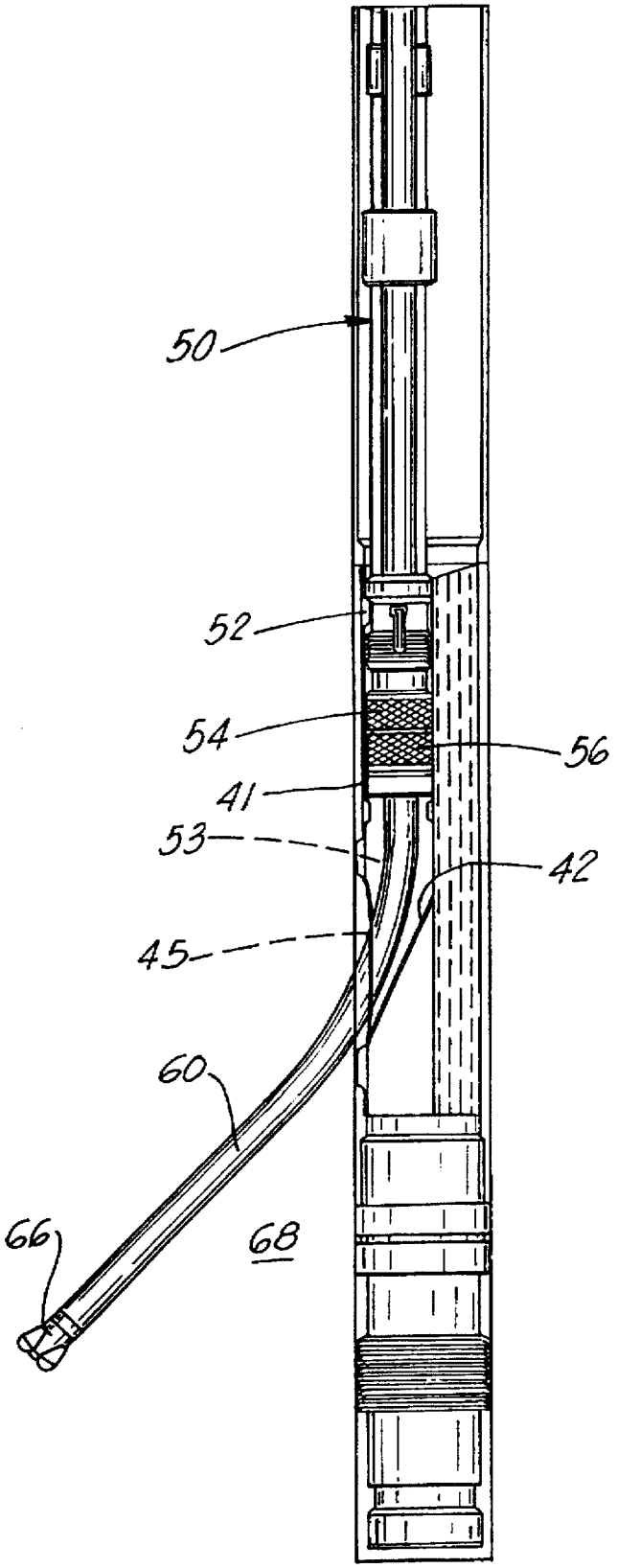
FIG. 2 is an overall cross sectional view of the radial tie back assembly positioned within the borehole including the collet assembly positioned therein and the drill string positioned therein drilling a radial borehole.

As seen in FIG. 1, the assembly 10, once it has been sealed in position with the top seal assembly 24 and the bottom seal assembly 16, the muleshoe J lock sub 34 would then be disengaged from the assembly 10 and brought up to the surface. Next, as seen in FIG. 2, there would then be lowered a collet latch assembly 50, which would be an assembly which would latch into shoulder portions 52 contained within the whipstock section 41 of the tie back assembly 10, and would include seals 54, 56 for securing it within the inner chamber 53 of the whipstock 41. There would then be lowered a drill string 60 into the collet latch assembly 50, and the drill string 60 would be of the type which includes a drill motor for rotating the drill bit 66 at the end of the string. When the drill bit 66 would make contact with floor 42 of the whipstock 41, the bit 66, or if necessary a mill bit, would drill a window 45 through the wall of the outer casing 14 as seen in FIG. 2. After the window 45 is drilled into the wall of the casing 14, the drill string 66 would then drill into the surrounding formation 68 and would commence drilling the radial borehole as illustrated in FIG. 2. The drill string 66 would then be pulled from the borehole, with the collet latch assembly 50 remaining in place.

Figure 3:
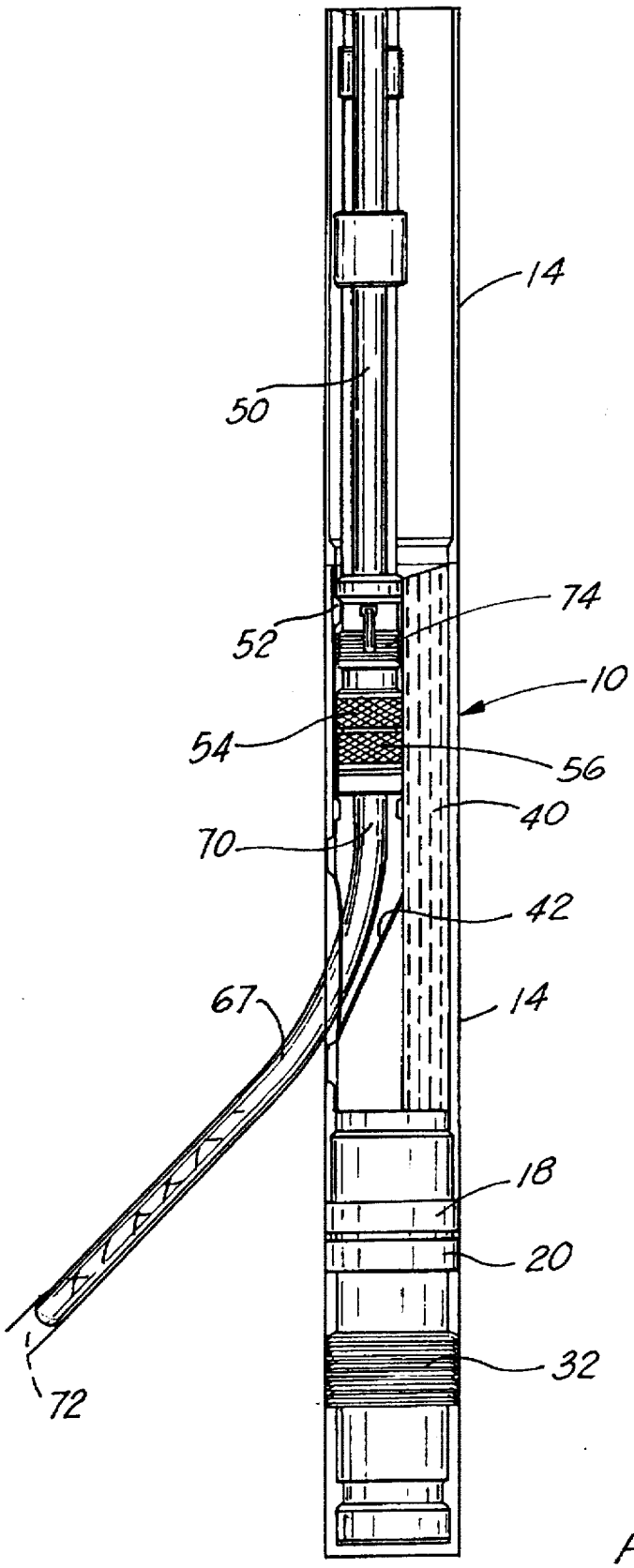
FIG. 3 is an overall cross sectional view of the radial tie back assembly with the production liner secured below the collet latch assembly during the completion process.
Figure 4:
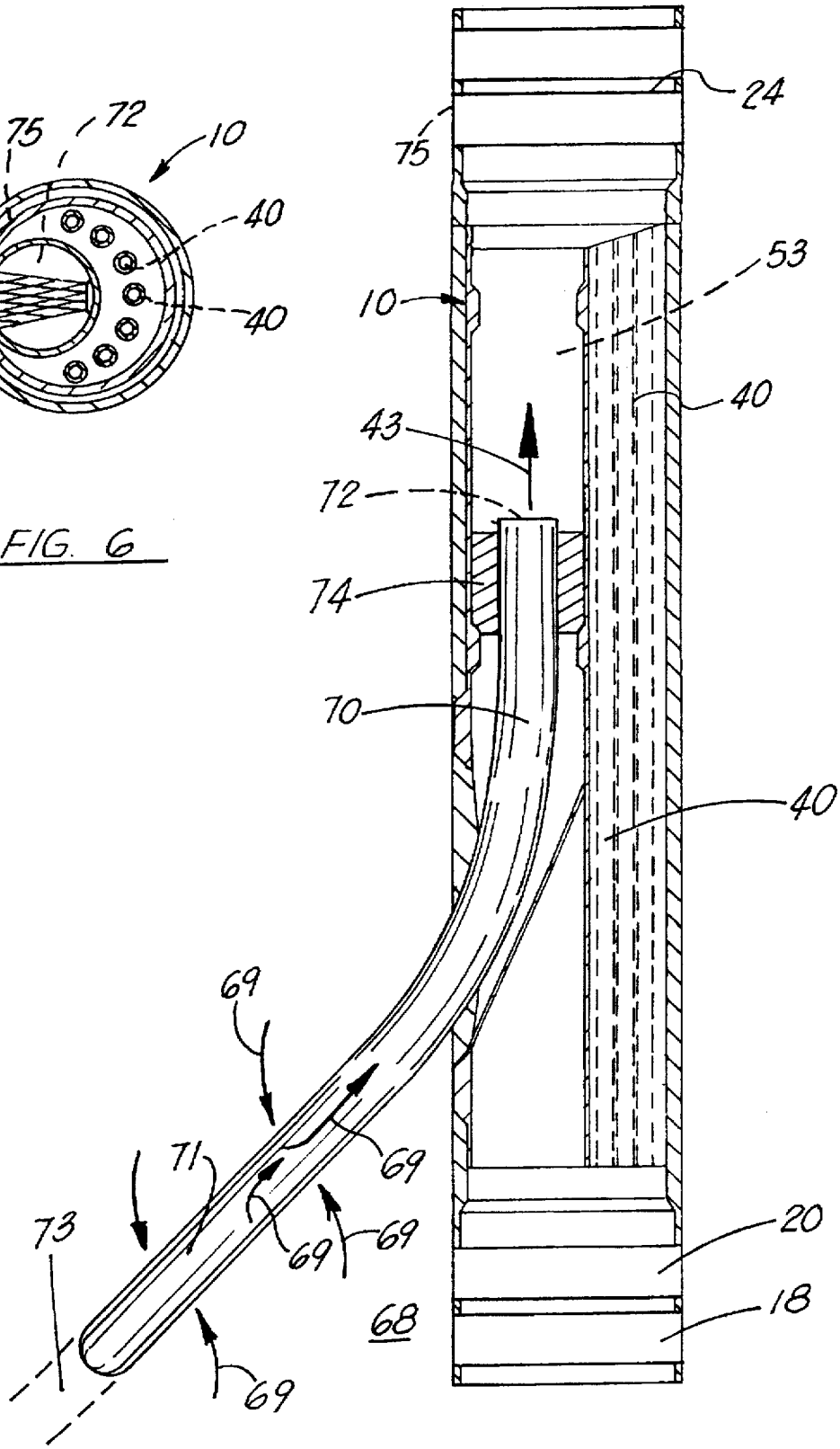
FIG. 4 is an overall cross sectional view of the radial tie back assembly with the production liner within the assembly and producing, and the collet latch assembly having been released and withdrawn from the borehole.

Turning now to FIG. 3, following this procedure, a production liner 67 is then lowered into the borehole through the collet latch assembly, with the production liner 67 secured within the interior production bore 72 as seen in FIG. 3. Following this procedure, the packer 74 is then engaged and set below the collet latch assembly in the inner chamber 53. The tubing running string is then released and pulled out of the hole as seen in FIG. 4. Following the positioning of the production string 70 in place, the collet latch assembly 50 is then pulled from the radial tie back assembly 10, and the radial tie back assembly 10 is maintained secured within the borehole 12, with the production string 70 extending into the radial bore 73 on its lowermost end, for receiving production from the formation 68 in the direction of arrow 69. The production string 70 would be secured to the packer 74 in the radial tie back assembly 10 for producing that part of the well. It should be noted as seen in FIGS. 3 and 4 that although some production may tend to seep between the wall of the production string 70, and the exterior of the assembly 10 because of the packer 74 sealing the production string 70, against the wall of the whipstock 41 and inner chamber 53, the only flow that can go upward through the production string 70. Likewise, in the annular space 75, between the assembly 10 and the exterior production casing 14, the upper and bottom seal assemblies 16, 24, present flow from going any further in that regard.

Figure 5:
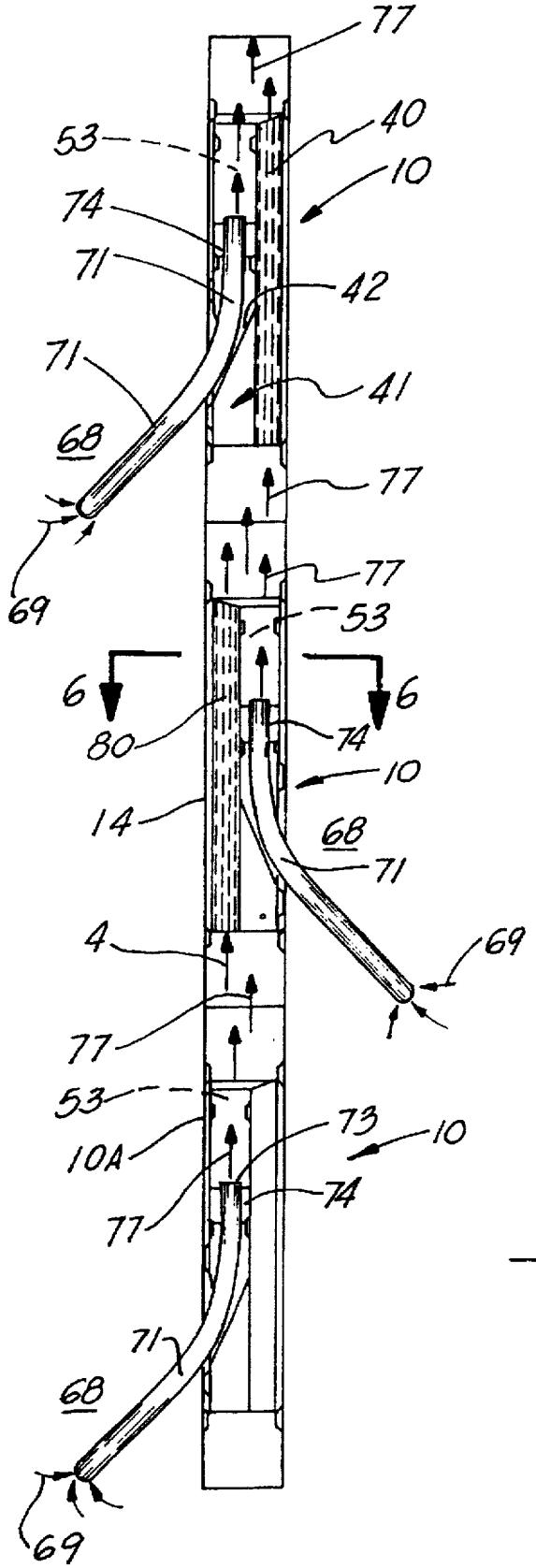
FIG. 5 is an overall cross sectional view of a plurality of radial tie back assemblies positioned within the borehole and producing from a plurality of radial bores simultaneously.

Turning now to FIG. 5, it is seen that there is a series of radial tie back assemblies 10 in place within cased borehole 12. For example, the lowermost assembly 10, as seen in FIG. 5, would be producing from the lowermost formation 68 following the process as was previously described using the components in as illustrated in FIGS. 1–4. The oil production would be received from the formation 68, and flow in the direction of arrows 69 into the production line 71, upward into the lowermost assembly 10. Because the production line 71 is sealed off from the formation and is secured within the assembly 10 via packer 74, the hydrocarbon flow would flow out of the top end 73 of production line 71 in the direction of arrows 77 into the chamber 53 of the assembly 10. It should be noted that as illustrated in FIG. 5, the lowermost assembly 10 is spaced apart a distance between the next upper assembly 10. Because assembly 10 is sealed within the casing 14 via seals 16, 24, the production would continue to flow upward within casing 14, until it encountered the next radial tie back assembly 10 on its way up to the surface.

Reference is now made to FIG. 6, which illustrates the radial tie back assembly 10, for example, along lines 6—6 in FIG. 5. As seen in FIG. 6, a cross sectional view of the radial tie back assembly shows that there is seen the outer casing 14, and the inner assembly casing 15 with annular space 75 therebetween. This space, of course, as stated earlier, would be sealed off the seals 16, 24, on its upper and lower most ends. Within the casing 15, there is illustrated the whipstock inner chamber 53, which would house the production casing 70 upward through the assembly 10.

The second system contained within casing 14 of assembly 10 would be the plurality of flowbores 40, each of which would extend through the length of the assembly 10, as seen in side view and FIG. 4 and in top view in FIG. 6. Therefore, when the production as seen in FIG. 5 which is moving in the direction of arrows 77 would reach the next level of assembly 10, upon encountering the assembly, the hydrocarbon flow would flow through the bores 40 through the next assembly 10. Upon reaching the top end of the assembly 10, again, if there was additional space between the assembly 10 and the next highest assembly 10, the hydrocarbon flow would be contained within the annulus of the casing 14, until it reached the next highest assembly 10. This would continue through the various assemblies used through the length of the cased borehole, until the hydrocarbon flow would reach the surface.

Therefore, at each radial tie back assembly as seen in FIG. 5, each assembly is receiving hydrocarbon flow from that particular level in the formation via radial production line 70 yet at the same time is allowing flow through the body of the radial tie back assembly 10 from those zones lower than itself. This flow may either be through pressure, or they may be a pump or series of pumps on the rig floor bring this flow upward. The key is that the flow is maintained within the interior of each of the radial tie back assemblies until it reaches the top of the cased hole where all of the it flows through the casing and for recovery. There is no flow which can seep back out of the radial tie back assemblies because of the series of seals and packers which are in place at the time.

The following table lists the part numbers and part descriptions as used herein and in the drawings attached hereto.

PARTS LIST

PARTS LIST

| Description | Part No. |
|---|---|
| radial tie back assembly | 10 |
| upper end | 11 |
| primary borehole | 12 |
| outer casing | 14 |
| inner surface | 15 |
| bottom seal assembly | 16 |
| lower annular seals | 18, 20 |
| lower packer | 22 |
| top seal assembly | 24 |
| upper annular seals | 26, 28 |
| upper end | 30 |
| lower end | 32 |
| muleshoe J lock sub | 34 |
| body portion | 35 |
| lower end | 35A |
| gyro-orienting tool | 36 |
| latching members | 37, 37A |
| flow bores | 40 |
| whipstock | 41 |
| angulated floor portion | 42 |
| arrow | 43 |
| window | 45 |
| collet latch assembly | 50 |
| top end | 50A |
| shoulder portions | 52 |
| inner chamber | 53 |
| seals | 54, 56 |
| drill string | 60 |
| drill bit | 66 |
| production liner | 67 |
| formation | 68 |
| lowermost formation | 68A |
| arrow | 69 |
| production string | 70 |
| production line | 71 |
| interior production bore | 72 |
| radial bore | 73 |
| packer assembly | 74 |
| annular space | 75 |

-continued

PARTS LIST

| Description | Part No. |
|---|---|
| arrow | 77 |
| top end | 79 |
| flowbore | 80 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A completion system for receiving hydrocarbon flow from multiple radial boreholes, the system comprising:

a) providing a principal vertical or horizontal cased well;

b) positioning an inner casing within a portion of said cased well, said inner casing further comprising seals at its upper and lower end potions for sealing against the wall of the outer casing, and having a flow bore therethrough, and further comprising a whipstock assembly having flow through openings;

c) lowering a smaller casing string in said cased well and engaging the whiptock assembly, said inner casing defining a radial tie-back assembly;

d) lowering a drill string into the radial tie-back assembly and drilling a radial well through the wall of the outer casing;

e) retrieving the drill string, and lowering a production liner into the radial tie-back assembly;

f) sealing around the wall of the liner, so that all production from the formation flows through the liner in the radial tie back assembly;

g) positioning a second radial tie-back assembly at a point above the first radial tie back assembly, and repeating steps c through e above; and h) allowing hydrocarbons within the formation to flow from the lower most radial tie-back assembly, through the bore of the next radial tie-back assembly, and p to the production facility.

2. The process in claim 1, wherein there is provided the step of lowering down a collet latch assembly and latching it into the radial tie-back assembly before lowering the drill string into the casing.

3. The process in claim 1, wherein there may be multiple radial tie-back assemblies throughout the length of the outer casing for producing multiple radial wells along the length of the outer casing in different orientations.

4. The process in claim 1, wherein the production flow from the lower tie-back assembly flows through a continuous flowbore in the body of the radial tie-back assembly.

5. The process in claim 1, wherein a collet latch assembly is removed from the borehole when the production through the assembly is ready to commence.

6. The process in claim 1, wherein the seals provided between the assembly and the cased borehole provide that hydrocarbon flow is from the production zone, through the flow chamber of the radial tie-back assembly and up the production casing to the surface.

7. A radial tie-back assembly for producing multiple radial wells in a primary production casing, comprising:

a length of inner casing having upper and lower seals for sealing the casing against the wall of the outer casing; a whipstock positioned within a portion of the inner casing; a flow bore extending through the length of the inner casing; a collet latch assembly on the radial tie-back assembly for accommodating a drill string therethrough to drill a radial well; a production liner extending from the assembly to the production zone of the radial well; and a flow bore through the assembly to allow production flow from beneath the assembly to flow through the assembly while the assembly is producing hydrocarbon flow from a radial well.

8. The assembly in claim 7, wherein there may be provided more than one assembly positioned within the primary production casing for allowing hydrocarbons to flow from one assembly upward, through the flow bores of each other assembly for retrieving at the production rig.

9. The assembly in claim 8, wherein there is further included sealing means to seal off production flow other than through the flow bore of the assembly body, or through the production liner.

10. The assembly in claim 8, further comprising a gyro-orienting tool to properly orient the whipstock in the proper direction before drilling commences.

11. The assembly in claim 8, further comprising a means on each assembly for engaging the assembly above or below it to allow continuous and uninterrupted flow through the assembly bores.

12. A system of utilizing a plurality of radial tie back assemblies for simultaneously producing multiple radial wells in a primary production casing, comprising:

a) providing a first radial tie-back assembly, comprising length of inner casing having upper and lower seals for sealing the casing against the wall of the primary production casing; a whipstock positioned within a portion of the inner casing; a flow bore extending through the length of the inner casing; means on the assembly for accommodating a drill string to contact the whipstock and drill a radial well through the casing wall; a collet latch assembly on the radial tie-back assembly for accommodating a production line extending from the assembly to the production zone of the radial well; and a flow bore through the assembly to allow production flow from beneath the assembly to flow through the assembly while the assembly is producing hydrocarbon flow from a radial well;

b) lowering the first radial tieback assembly and orienting the assembly to a certain depth within the principal borehole;

c) drilling a radial well from the assembly into the formation;

d) fixing a production string extending from the assembly into the production zone of the radial well to receive hydrocarbon flow;

e) placing a second radial tieback assembly in the principal borehole above the fist radial tie back assembly, and repeating steps c and d:

f) allowing production flow from the lower radial well out of the radial tie back assembly, upward into a flowbore of the upper radial tieback assembly, so that the flow can be retrieved at the rig floor, with the upper tie back assembly not impeding flow from below it.

13. The system in claim 12, wherein there may be positioned a plurality of radial tie back assembly within a single borehole, each producing flow from a radial well, the hydrocarbon flow from the lower assembly flowing through those assemblies above it to achieve capture of hydrocarbon flow from all of the assemblies simultaneously.

* * * * *